US006109186A

United States Patent [19]

Smith et al.

[11] Patent Number: 6,109,186

[45] Date of Patent: Aug. 29, 2000

[54] INTERACTIVE SLOT CAR SYSTEMS

[76] Inventors: David Smith, 102 Liberty Ct., Summerville, S.C. 29485; David Brobst, 3029 Esplande Suite F, Chico, Calif. 95973

[21] Appl. No.: 09/386,327

[22] Filed: Aug. 30, 1999

Related U.S. Application Data

[63] Continuation of application No. 08/964,596, Nov. 5, 1997.

[51] Int. Cl.[7] ..... B60L 15/00

[52] U.S. Cl. ..... 104/295; 104/296; 104/305; 246/187 A

[58] Field of Search ..... 104/295, 296, 104/304, 305; 246/187 A

[56] References Cited

U.S. PATENT DOCUMENTS 3,926,434 12/1975 Cannon, Jr. ..... 273/86 B 4,247,107 1/1981 Smith, III et al. ..... 104/296

5,749,547 5/1998 Young et al. ..... 246/187 A

*Primary Examiner*—S. Joseph Morano

*Assistant Examiner*—Robert J. McCarry, Jr.

*Attorney, Agent, or Firm*—B. Craig Killough

[57] ABSTRACT

An interactive slot car game having a multiple lane slot car track for electrically powered slot car. The trackway has a pit lane which is positioned on the same side of the track for all cars, with a pit position for all cars, with each pit position located on the same side of the pit lane. The game has an intermediate control device which limits the control that the user has over the speed of the slot car, and can be programmed to simulate occurrences such as tire wear or fuel shortages. The intermediate control device limits car speed due to actual occurrences during racing, such as a car in another lane exiting the track, thereby creating and enforcing caution periods, as in auto racing. Light signals and aural signals are generated in response to the game conditions, occurrences during the game, or randomly generated events.

15 Claims, 8 Drawing Sheets

INTERACTIVE SLOT CAR SYSTEMS

This is a continuation, of application Ser. No. 08/964,596 filed Nov. 5, 1997.

FIELD OF THE INVENTION

The present invention relates to amusement devices generally, and is particularly related to electrically powered, controllable slot cars and slot car tracks.

BACKGROUND OF THE INVENTION

Electric model car racing systems have, for well over the past 30 years, generated a large amount of enthusiasm and commercial interest. As the interest in such devices has increased, so has the technology used to support these model car racing systems.

The related technology began with sets having vibrator cars, and has progressed to today's sophisticated scale vehicles enhanced with magnetic attraction. Tracks involved with these systems range from simple two lane home slot car tracks, to slotless systems, to sets with electronic enhancements. Large commercial multiple lane tracks, including features such as magnetically enhanced copper coated steel braid conductors, operate around the globe and offer an assortment of track configurations to increase the required skill level and realism of model racing. Many commercial slot car raceways use personal computers (PC's) to post time, speed, and lap data for each operating lane.

Each technological advancement through the evolutionary process of model car racing has brought with it an incremental increase in the enjoyment for model racing enthusiast. Various attempts have been made to improve the model road race systems of the prior art and to increase the realism of these systems. For example, Mabie, et al., U.S. Pat. No. 3,531,118, discloses an electronic lap counter for vehicular racing games. A light board is used to display the completed lap count. Conkins, et al., U.S. Pat. No. 3,572,771, discloses a system for counting laps completed, timing individual laps, the elapsed race time, and visually indicating these parameters to the operators.

Magnetic traction enhancement for miniature vehicles, now the standard in HO scale model racing, is disclosed in Bernard, U.S. Pat. No. 4,031,661. Smith et al., U.S. Pat. No. 4,247,107, discloses an apparatus for sensing static pit position and laps completed, a system for calculating and displaying various track functions, and a means for introducing simulated failures by removing power supplied to a specific electric vehicle lane.

While each of the above patents represents an increase in the sophistication and realism of the electric model car racing systems, each falls short of providing an accurate simulation of today's real motor sporting events. Prior art simulations use rheostat hand controllers to directly vary the voltage to the track and these systems have no means of indirect control in response to specific track events. Power to the vehicles is either on or off, with no reduction steps available for forcing players to slow their cars for running starts, simulated malfunctions, fuel shortages, or caution periods. The prior art devices do not have means to detect vehicle crashes, nor means for realistically enunciating such events. Prior art examples either use mechanical lap sensing devices that interfere with the smooth operation of the cars, or "dead strips" that are electrically isolated from the remaining track and cause the cars to stop on the electrically segregated strip. These limitations, in conjunction with the lack of a realistic and functional pit area segregated from the main track way, make the prior art devices inferior in race simulation and entertainment value.

An accurate scale racing simulation should include segregated track events governed by specific, but separate, rules for practice sessions, qualifying, and racing. These simulations need flag signals (i.e. white, yellow, and green), dictated by actual track occurrences, such as "crashes," and means for varying the operational parameters available to the participants which are responsive to specific track events such as "crashes", or a simulation of limited resources, like fuel usage and tire wear. Improvement in the realism of the track operations, including segregated pit actions and induced chance, is also a need which exists.

SUMMARY OF THE PRESENT INVENTION

Objects and advantages of the present invention are set forth herein. These objects and advantages include:

A Novel Interactive Intermediate Control System for the Control of Vehicles

The invention may use rheostat controllers commonly available, while providing an interactive intermediate control device, such as a microprocessor as disclosed herein, to interpret a supplied lower voltage from the controller to the processor, and command a corresponding higher voltage to the track. The intermediate control device maintains direct control of the vehicles, and modifies control when instructed by the control program, in response to programmed track events such as practice, qualification, and race conditions, or sensed events like starts, cautions, pits, re-starts, and victory. The intermediate control device also provides means for detecting the status of track activities, by the use of a novel comparator system which detects low voltage. When voltage in a lane drops to zero, as compared to the commanded input voltage, a departure of a car from the track, or a "crash," is interpreted. In response, the intermediate control device slows, or otherwise modifies, the available voltage to the other lanes, thereby slowing the cars to simulate a "caution" condition, as in real racing. Further, visual and aural signals indicate a caution condition.

Track detection is used by the intermediate control device to command programmed actions and enunciations during simulated racing events. The intermediate control device also has the added advantage of power reduction capability for programmed fuel shortages, simulated tire wear, or other random events that occur during real racing like caution periods. A further advantage of intermediate control device is the ability to introduce acceleration and deceleration factors enhancing the simulated performance of the racing vehicles. Still further, the intermediate control device can inject a power spike in the acceleration program, thus overcoming an old problem in the art of stalled cars that need a push to get started. A further benefit to this invention is the elimination of excessive heat generated in the rheostat controllers of conventional systems, without incurring the added expense of electronic controllers for each individual player position.

A Novel System for Providing Static or Dynamic Vehicle Position Data to an Intermediate Controller The invention provides direct inputs to the intermediate control device and eliminates mechanical lap counters and dead strips for sensing laps, speed, time, pit position or sequence. The device may comprise simple and inexpensive magnetic reed switches coupled to a microprocessor. Reed switches may be positioned under the track at the start/finish line, each individual pit, and at a predetermined point prior to the start/finish line to provide the microprocessor position data by dynamic or static activation in close proximity to magnetically enhanced vehicles. The data may then be used to provide the appropriate intermediate control actions and activate both audible and visual enunciations for a specific track event The data may be used for sequencing cars in the proper order during dynamic starts and re-starts, crossing of the start/finish line, providing lap, speed, and timing data, and to provide positive static or dynamic pit detection allowing penalties for missed pits. The invention provides means for comparing the status of the cars in each lane, and modifies the available power accordingly. The invention allows flying starts by controlling the relative positions of the cars on the start. Standing restarts, which are unrealistic, are not necessary. Realistic pit activities are created, and there are no dead strips that cause cars to slow or stall on the track.

A Track System Using Three Crisscross Sections for the Physical Segregation of a Same Sided Pit Area from the Main Track Way The invention may employ three lane cross overs, or "crisscross" areas, placed strategically in the track in conjunction with pit entry and exit lanes. The first crisscross section is placed in a position prior to the pit entry way and the second crisscross is placed in the pit lane area. This double crisscross allows the use of same side pitting, which has not been used in dual slot or lane devices. A third crisscross section is positioned before the pit exit lane on the main section of track. This configuration maintains the correct electrical continuity of the track. When the pit lane crisscross is positioned close to the designated pit positions of the cars, the added realism of bumper to bumper congestion in the pit area is present, with a lane crossing potential as racers enter and exit their pits from the same side of the track. This novel approach solves the problem of unrealistic pit areas positioned on the main trackway of slotted dual rail systems, or pit functions positioned on opposite sides of a track.

DESCRIPTION OF THE PREFERRED EMBODIMENTS

The invention may be embodied in a direct current (DC) powered dual lane HO scale track system, using DC powered slot cars. The trackway 2 is preferred to be a dual slot or dual lane trackway, which incorporates a triple crisscross configuration allowing "same sided" pits, that is, pits for both lanes which are on the same side of the track. The pit is segregated from the track itself, and into a single pit area.

Figure 1:
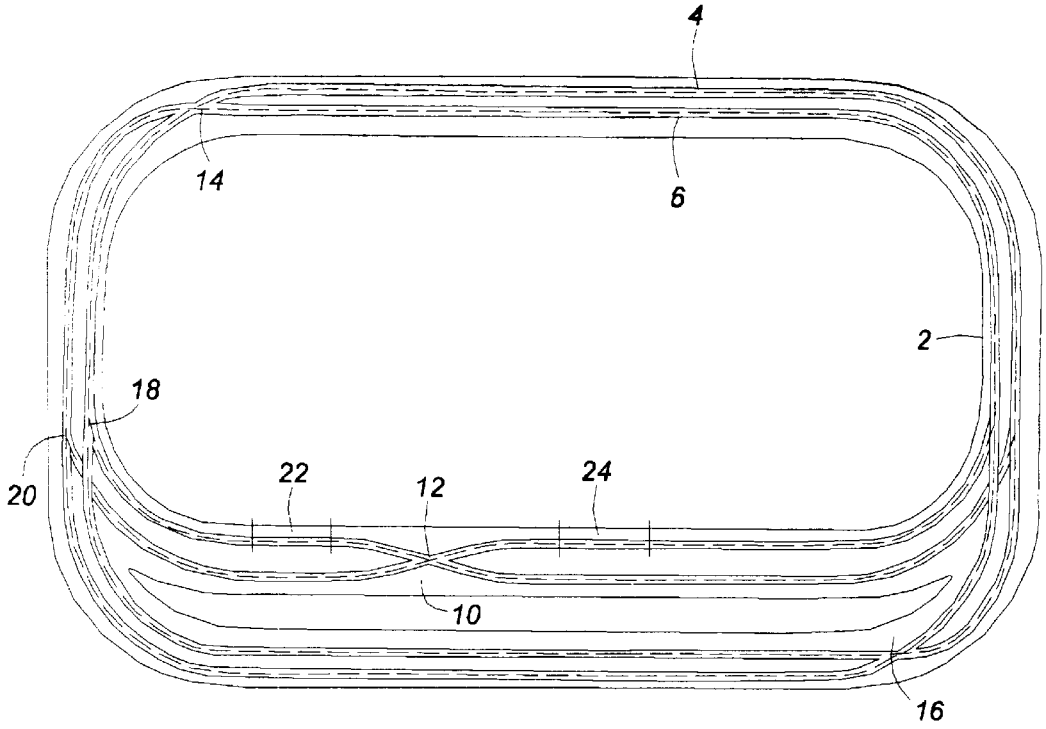
FIG. 1 is a schematic of a trackway for slot cars as used.
Figure 2:
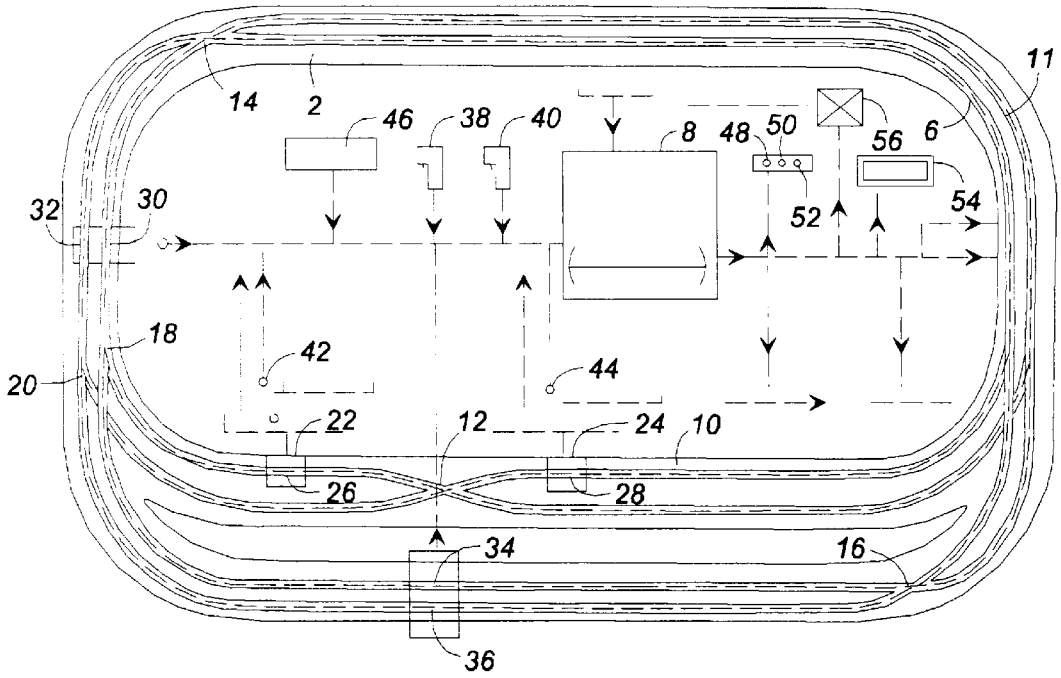
FIG. 2 is a schematic showing devices which control input and output functions of the interactive intermediate control device as they relate to the trackway.
Figure 3:
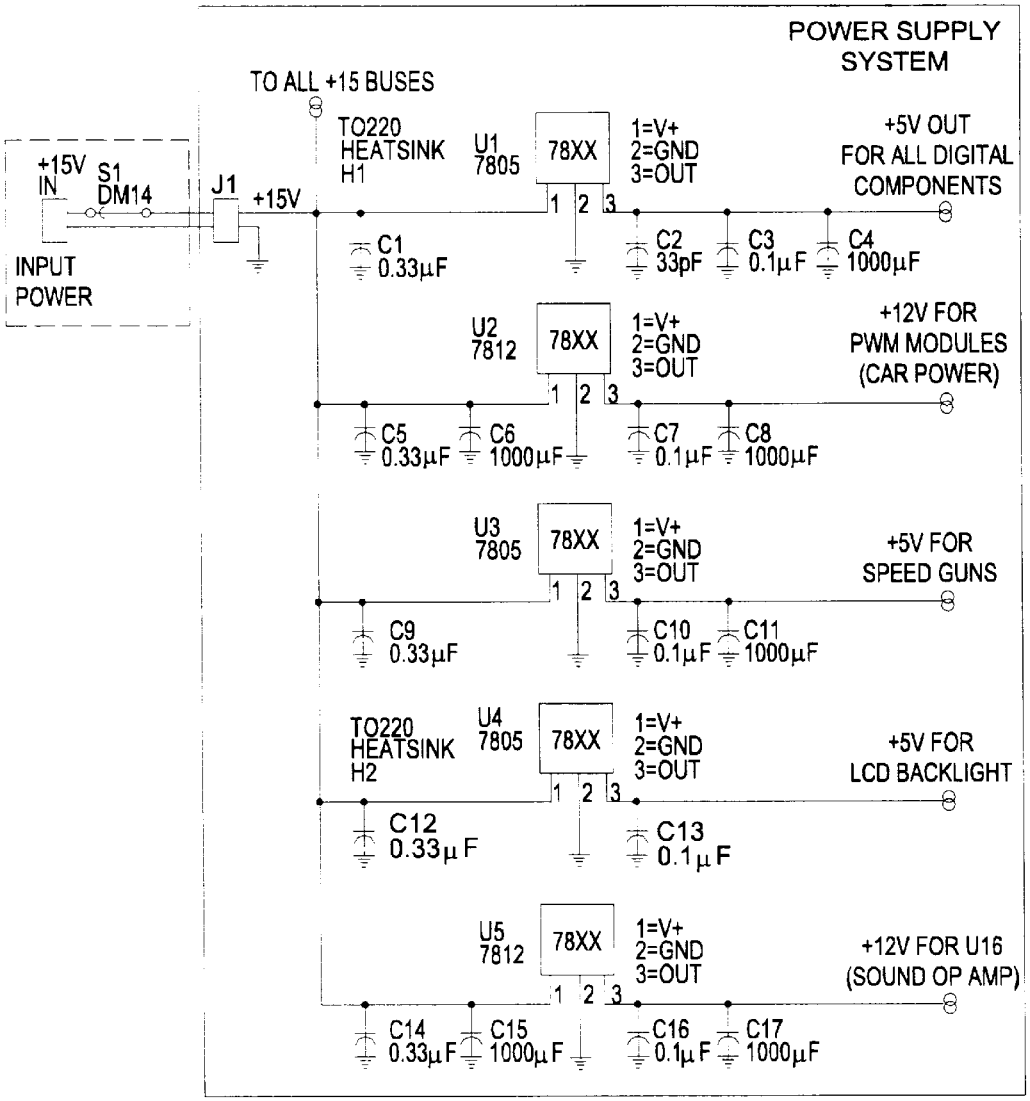
FIG. 3 is a schematic of a circuit of the power supply busses for the interactive intermediate control device and other devices.

The track configuration shown in FIGS. 1 and 2 is a dual slotted oval configuration having a first lane 4 and a second lane 6. Other configurations, such as road courses, may be used. The dual slotted configuration may also be supplemented with addition lanes.

Vehicles of various scales using either AC or DC power may be used. Analog-digital-analog control formats may be converted to analog-digital-digital control formats, with the incorporation of digitally controlled vehicles, while still using the intermediate control feature of the present invention.

In the preferred embodiment, the intermediate control device 8 is a Microchip PIC 16C77 micro-processor. Other processors of other chip designs may be used. The preferred embodiment also incorporates magnetic reed switches placed under the track to detect either a static or dynamic position of magnetically enhanced vehicles. Other devices having sensing capabilities may be used.

The preferred embodiment of this device uses triple crisscrosses to achieve same sided pits in conjunction with the interactive intermediate control device. Pit activities common in real racing events are thereby achieved, and a high degree of realism is attained. The same sided pit and the interactive intermediate control device may be used separately.

Referring to the drawing figures, FIG. 1 shows the layout of a dual slot, twin conductor system having "same sided" pits. The segregated pit area 10, provides pits for both lanes on the same side of the track. The track uses three crisscross devices, with crisscross 12 in the pit lane, and two individual crisscross sections strategically positioned on the main portion of the oval track. The triple crisscross configuration provides a pit potential to each vehicle not only on the same side of the track, but also on the same side of the pit lane, as in real racing. A segregated pit area is also achieved. This pit structure provides the required electrical continuity to the DC powered vehicles.

Figure 4:
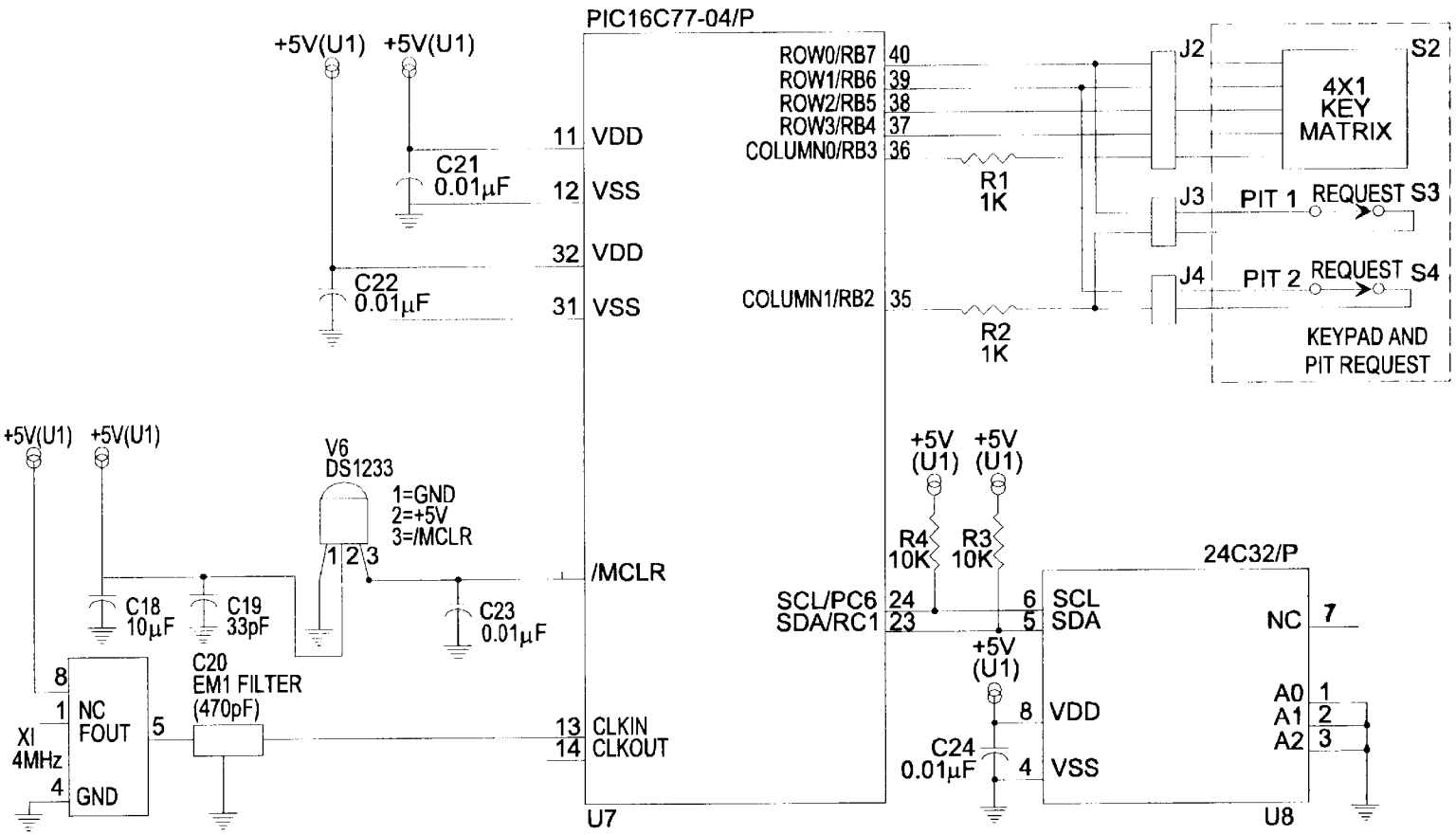
FIG. 4 is a schematic of a circuit of the reset, clock, key pad and memory for the interactive intermediate control device.
Figure 7:
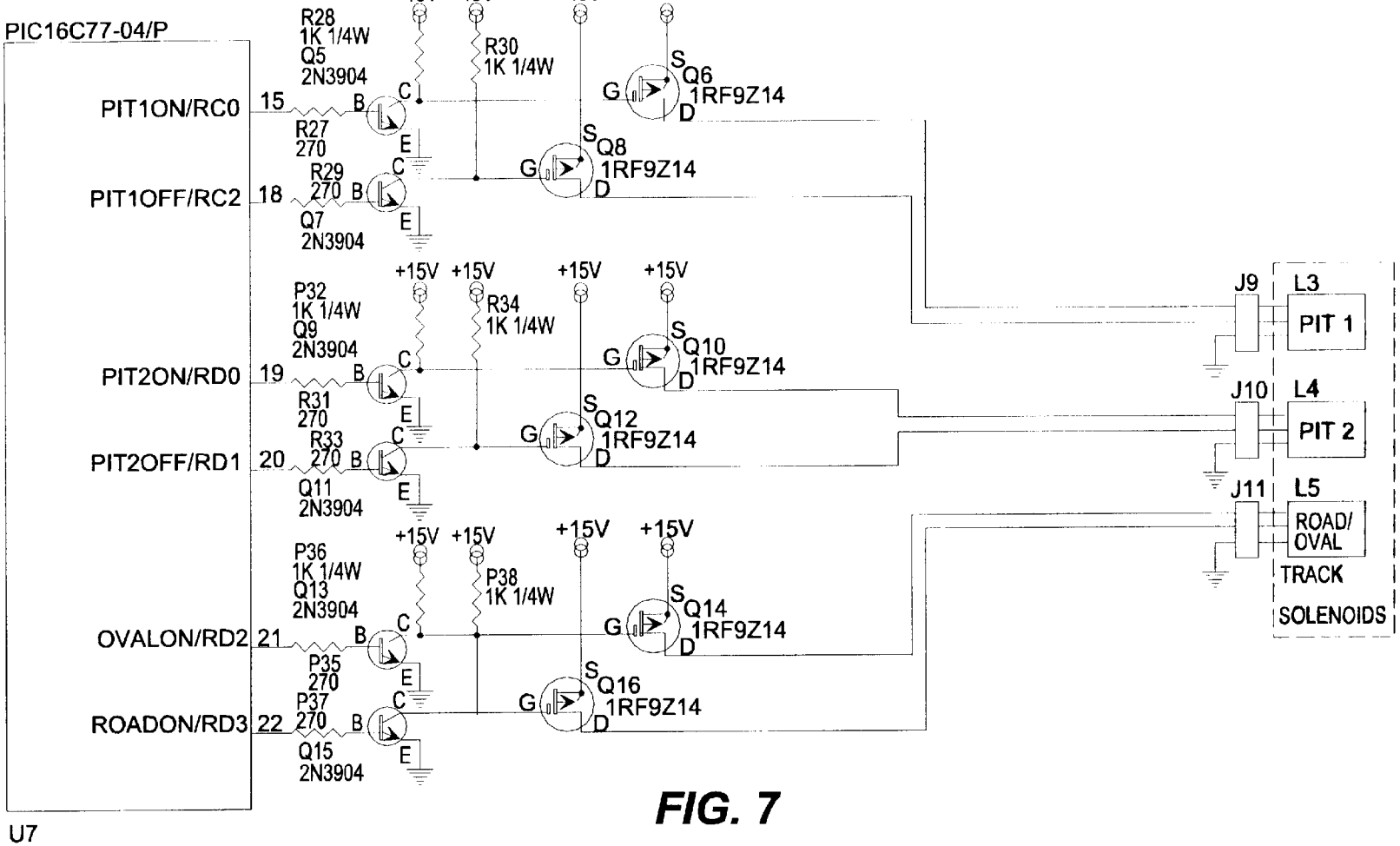
FIG. 7 is a schematic showing the switches for track routing and position.
Figure 8:
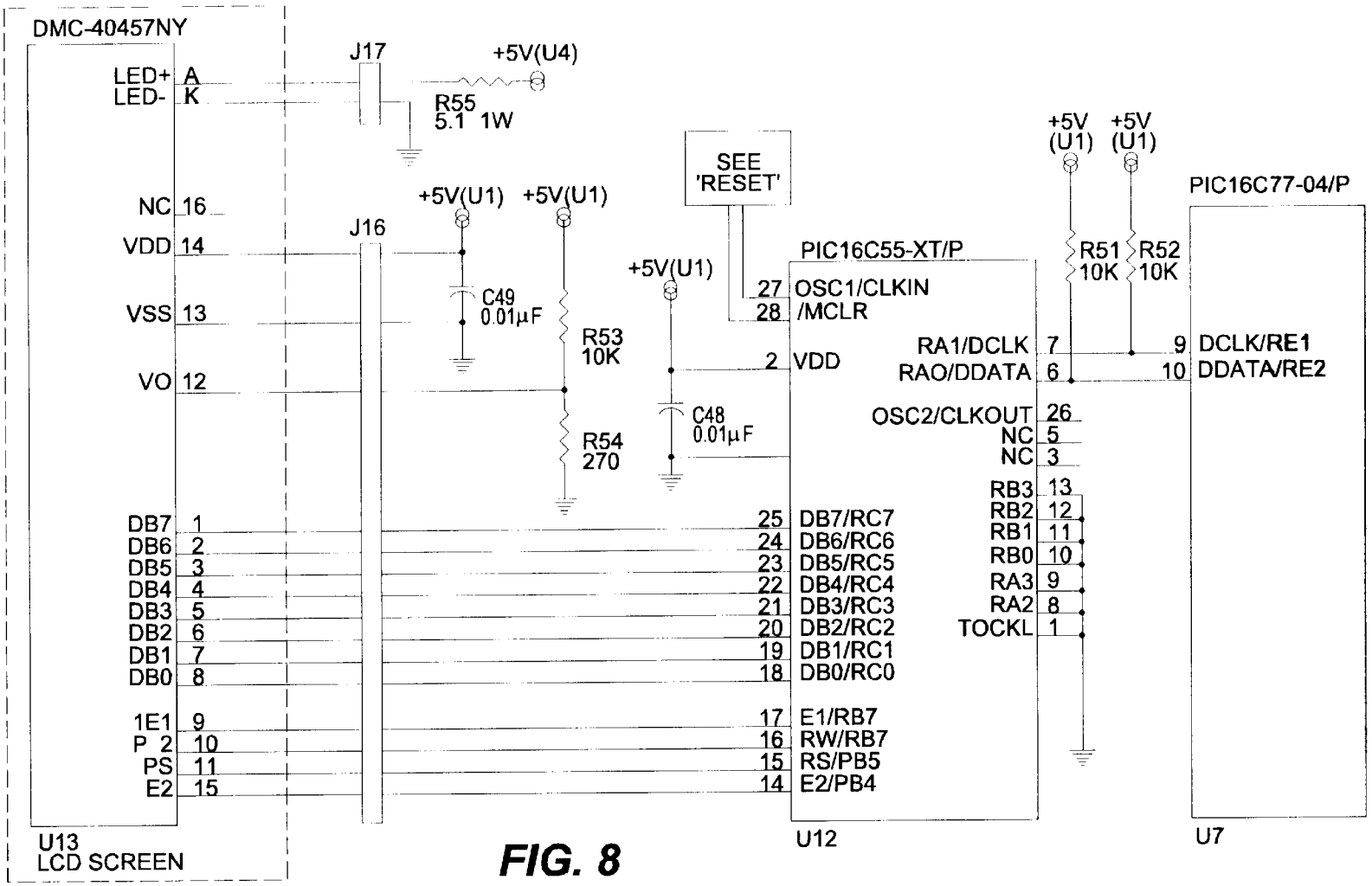
FIG. 8 is a schematic showing the LCD display and LCD control.
Figure 9:
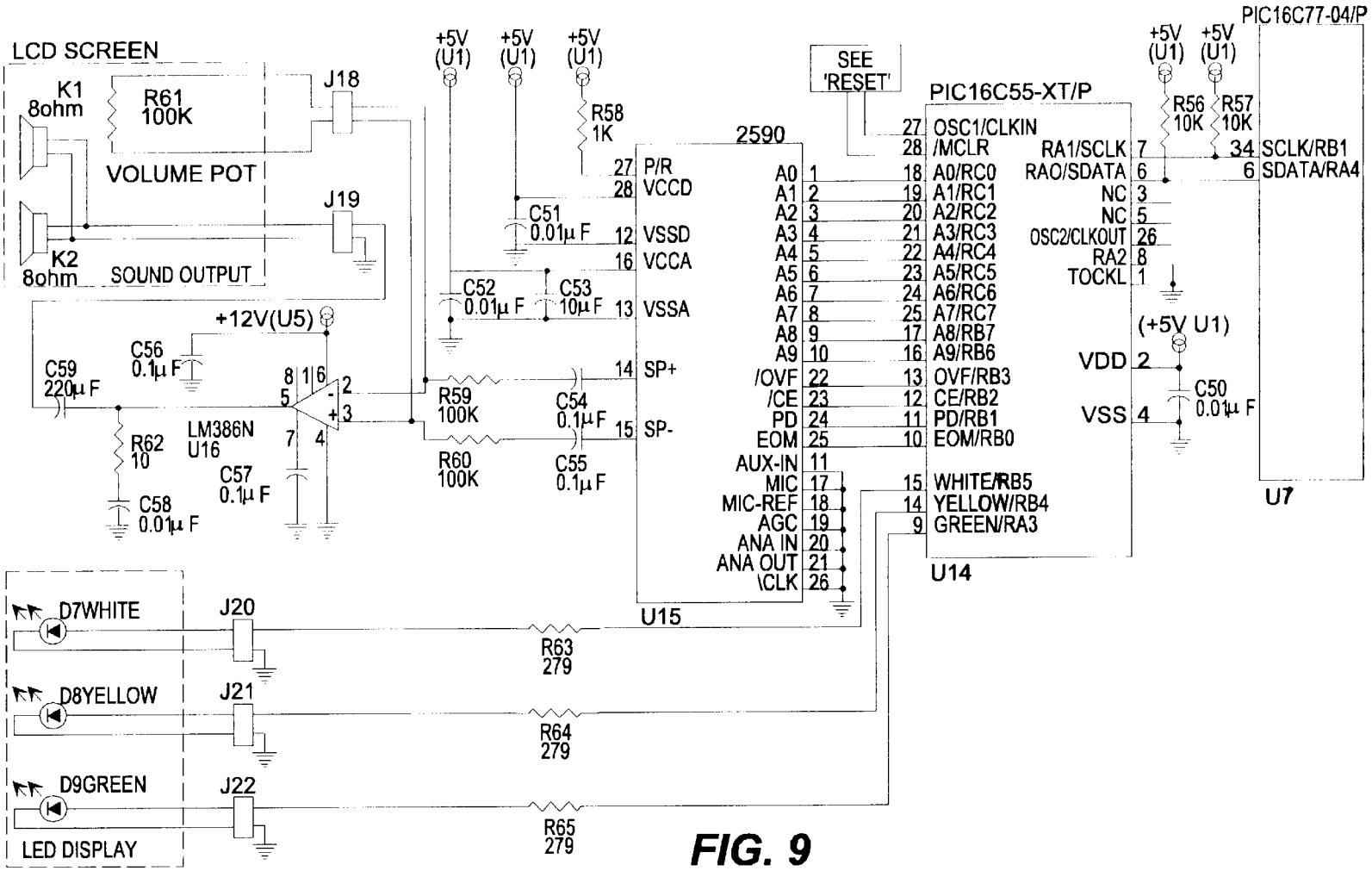
FIG. 9 is a schematic showing the sound devices and LED controls.

As shown in the drawing figures, one main trackway crisscross 14 is placed prior to the pit lane entrance, with a corresponding, but opposite, crisscross 16 placed between the pit lane entrance and the pit lane exit. Slot diverters 18, 20, such as a solenoid operated and microprocessor controlled device (FIG. 7, L3), is used to divert the slot cars from the main trackway to the pit lane. The diverter system may be commanded by the actuation of a control switch, such as a SPST momentary push button (FIG. 4, S3), which communicates with the microprocessor. The intermediate control device actuates the solenoid directing, a car to the pits. Alternatively, the intermediate control may override the user's command inputs if the pits are "closed" to the user, due to software generated conditions. When activated, each slot car is guided, via the slot, to its individual pit position 22,24. Each pit position may be equipped with sensors 26,28, such as reed switches, placed under the track, to detect the static or dynamic position of the vehicles. When the sensor is activated by the position of the car, information is provided to the intermediate control device about the static or dynamic position and condition of a vehicle in the pit, and with the microprocessor clock and software, the intermediate control device may modify inputs to the car, or the other car, through the track. Such software generated pit functions may include pit grading, with specific audible or visual indications based on time penalties, where the track power is removed from, or limited to, the vehicle for a specific amount of time. The software may detect if a vehicle misses the pit position, and force a player to return to the pit, via the processor controlled slot diverter, with reduced power available. The information relayed by each pit sensor may also be used to provide time, speed, and lap information to the interactive intermediate control system (IICS) for interactive control of the racing game functions.

Figure 5:
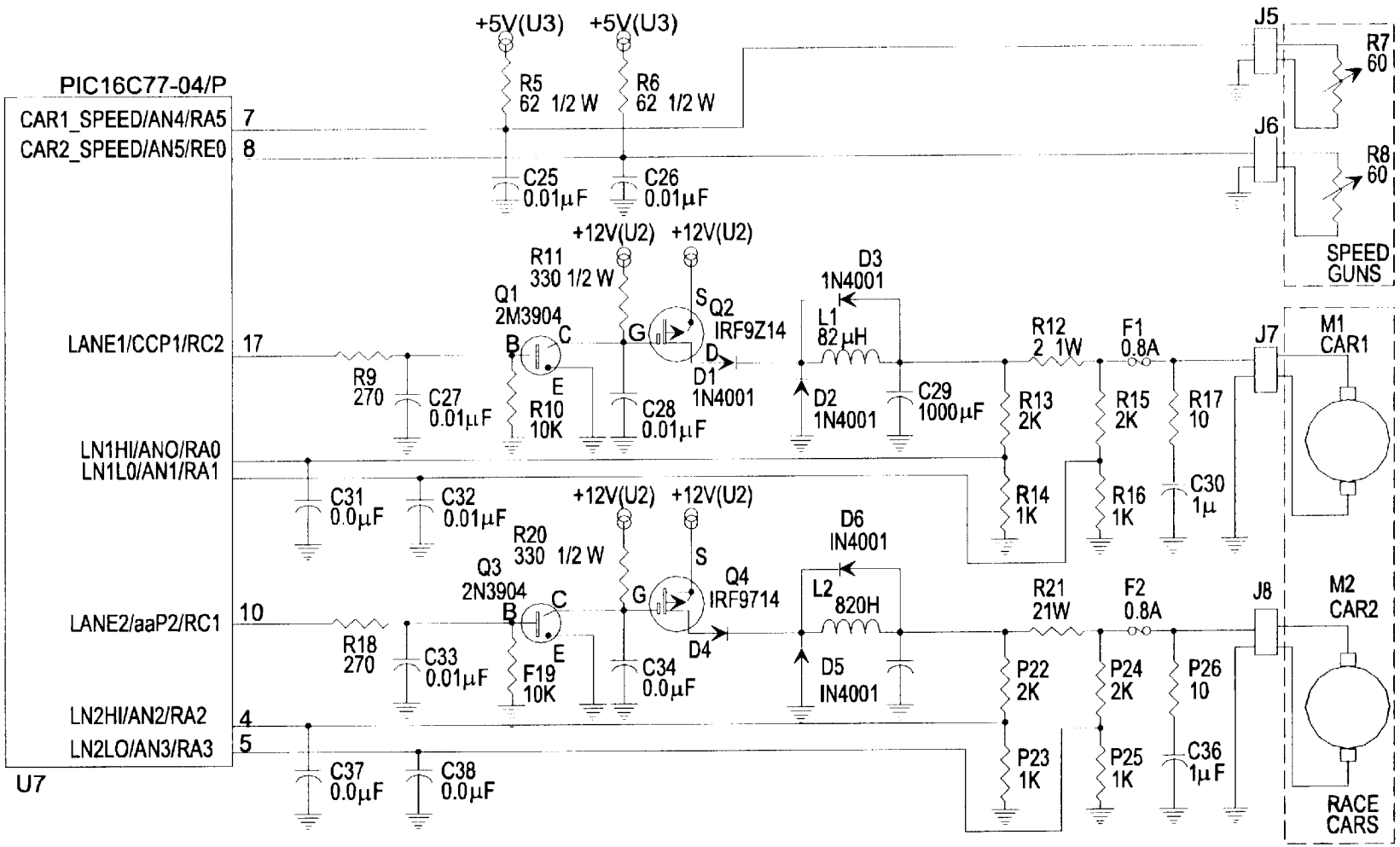
FIG. 5 is a schematic of a circuit of the controllers, car power and current monitoring for the interactive intermediate control device.
Figure 6:
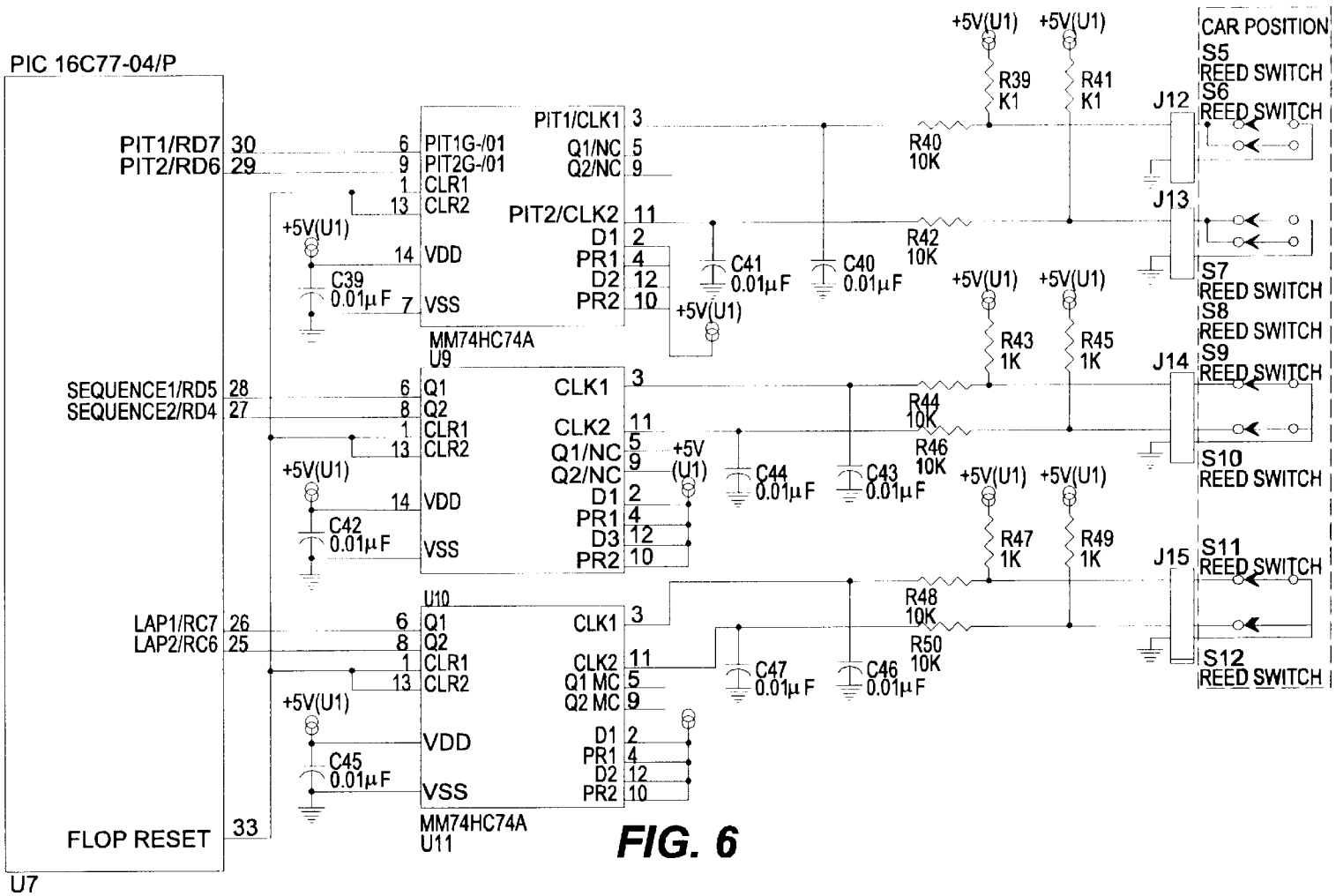
FIG. 6 is a schematic showing the car position sensors in a circuit and connected to the interactive intermediate control device.

FIG. 2 provides a schematic illustration showing devices which control input and output functions of the interactive intermediate control device as they relate to the trackway. Input functions to the intermediate control device are received from two sequence sensors 30,32, two start/finish line sensors 34,36, two pit position sensors 22,24, two rheostat type hand controllers 38,40, two SPST momentary push buttons 42,44, and a 4×1 matrix keypad 46. Analog inputs received from the hand controllers are converted to digital information via an 8-bit A/D converter internal to the IICS main microprocessor 8 (FIG. 5, U7), while the other input devices are configured to interface directly to the IICS digital inputs. Output from the system provides the interactive control of power to the DC powered slot cars, pit solenoid switch activation for two pit lane slot diverters, activation of three LEDs 48,50,52 of differing colors to indicate track conditions, information outputs to an LCO display 54 about the game status and individual slot car parameters, and the control of an audio system 56 responsive to software generated commands. The preferred embodiment also includes a third solenoid (FIG. 7, L5) controlled by the intermediate controller that may be used to divert either one or both lanes to an alternate trackway via a dual or single slot diverter arrangement.

Reference is made to the control devices for lane 1, unless noted. Lane 2, or other subsequent lanes, employ identical sensors and devices. FIGS. 3 through 9 are schematics of the input and output devices as configured for the interactive intermediate control device (IICS). The primary function of the IICS is to control the output voltage of the vehicle power supply, by means of a control program specific to this function. This function provides software generated operation to DC powered slot cars, enabling increased, and more realistic, simulation potential to slot car enthusiasts.

Desired car speed is variably selected by a player by means of a hand-held potentiometer R7. These hand controllers are common in the art and use a resistor or potentiometer to directly vary the amount of power available to the track, thereby increasing or decreasing the speed of the slot cars. In the IICS configuration potentiometer R7 is in a voltage-divider configuration with R5 and provided a supply of 5V. Potentiometer R7 is specified as an industry-standard 60 W maximum resistance, but other resistance applications could be used. In this configuration, a voltage which is in a range of 0–2.5V corresponds to the limit positions of R7, with zero voltage being the signal corresponding to increased vehicle speed with the trigger of the hand controller squeezed, and 2.5V being the signal corresponding to stop, with the trigger released. The system detects the presence of the hand controllers in the circuit, without individual controller activation. The output voltage of potentiometer R7 equates to a vehicle speed command, and is read in by the main system micro-controller U7, via the on-board 8-bit A/D converter. This speed command is then relayed by micro controller U7 to an NPN transistor Q1 to boost the 0–5V PWM signal out of potentiometer U7 to a 0–12V PWM signal, to drive the P-channel MOSFET Q2. The switching voltage supplied to MOSFET Q2 is pre-regulated by the linear power supply U2 to ensure that demands on the power, supply will not adversely affect other circuitry in the system. P-Channel MOSFETS are used because both lanes share a common ground. From the output of MOSFET Q2, the 0–12V PWM square wave signal is filtered via L1, C29, R17, and C30 to achieve a DC output to power the slot car. R9, C27, R10, R11, and C28 each act as low pass filters to reduce EMI. D1, D2, and D3 are used to prevent voltage spikes from damaging the circuit. A self-resetting fuse F1 is used to protect the circuitry from a short circuit. Removal of a short-circuit condition resets the fuse, and the game can continue normally. In this configuration, 128 discreet speeds are present which can be commanded by each individual player through micro-controller U7.

Because power to the car is controlled by the main system micro-controller, the power to the car can be modified at any time when dictated by software generated, or detected, conditions in the game, independent of the position of potentiometer R7. Power modification or removal is available based upon detected track departures, or crashes, or other track conditions created by the players, or programmed events, such as simulated tire wear or fuel shortages. Power reductions are used to enforce caution periods, by means of speed reductions, for all players following a detected crash.

Main system micro-controller U7 monitors the number of laps each car has completed by the activation of track sensors. This number, in conjunction with the total number of laps in the race, is used to calculate when pit stops should occur and when tires "wear out." These trip points are simple percentages of the total number of laps in the race or pit sequence. When the trip point is reached, the controller begins implementing a series of power reductions which simulate the action in a real racing environment (i.e. worn tires equal slower lap times). If a car does not pit at least once during the programmed pit sequence, it may "run out of fuel," with available power terminated by micro-controller U7, if a negative probability exists, or with the power reduced, if a positive probability exists, for at least another lap. Probability functions are controlled by micro-controller U7, and are produced by an internal software random number generator. This probability function may also be used for random grading of pit activities or the introduction of random caution periods for a variety of realistic reasons, such as simulated debris on the track or weather conditions. The IICS system induces software generated chance into the game.

The IICS also includes a current sensing mechanism which enables the main system micro-controller U7 to sense if a car is on or off the track. Current is sensed by resistor R12, a 2 W 5% resistor. The voltage at either end of the resistor is measured with the 8 bit A/D converter found internally to micro-controller U7. Resistors R13, R14 and R15, R16 form voltage dividers to ensure that the maximum voltage read by micro-controller U7 does not exceed 5V. The current is the difference between the two voltages divided by the resistance of resistor R12. By sensing the current being supplied by the power supply system and comparing it to the power command of potentiometer R7, micro-controller U7 can compare the voltage commanded to the voltage supplied over a specific time period and determine if a car has departed the track. This comparative capability constitutes a novel means of track detection and enhances the game function over prior art examples, by providing caution period which are specific to game conditions.

Track detection information is used by micro-controller U7 to determine the conditions on the track in conjunction with applicable software generated inputs. Caution period power reductions are generated, and crash conditions on the track are enunciated by aural means, such as a crash sound, and visual means, such as a yellow light, either during a race period, or to signal an end of qualification during a software generated qualification period.

To enhance the performance of the slot cars in comparison to real racing cars, main system micro-controller U7 can ramp up the PWM signal to the power supply at a slower rate than commanded by potentiometer R7. This feature slows the rate of acceleration of the slot car, yielding an acceleration rate which is more realistic in appearance. Stopping is enhanced by using the programmable capability of micro-controller U7 to slowly reduce the PWM signal, instead of immediately turning off the power to the car. Again, this has the effect of slowing the rate of deceleration, and provides a better simulation of the momentum experienced by real racing cars traveling at high rates of speed.

Basic DC motor control limitations can be minimized. DC motors typically need a disproportionately large current to start their rotation. The main system micro-controller U7 may provide a high power spike when the cars are first started. This starting high voltage spike is accomplished by use of a non linear power curve internal to the power program, and commands a disproportionately high voltage momentarily at the onset of the lowest commanded voltage by the player through the hand held controller.

Micro-processor U7 is provided analog detection of vehicle position by the use of a track sensor system. Each racing lane is provided with vehicle sensors which may be magnetically sensitive reed switches. These sensors may be placed under the track in the individual pits 26,28,S5, at the start/finish line 34,36,S11 and at a point used to sequence the cars for running starts and re-starts in the correct order 30,32,S9. Inputs to micro processor U7 are provided by the D-type flip-flops (U9,U10,U11) used as latches to store the analog inputs of the sensors. U7 may interpret the -activation of these sensors as either static or dynamic, based on a software generated time interval for an activation period. Dynamic activation is used for lap counting and speed/time calculations, and may be sensed by either sensor S5 or sensor S11. Dynamic activation of sensor S9 and sensor S12 is used to properly sequence vehicles by creating a micro processor U7 generated sequence and time gate for the passing of both racing vehicles and constitutes a lane comparison potential not know in the art. This lane comparison feature is used to ensure that the designated race leader or pole qualifier crosses the start finish line first during running starts or race re-starts after a caution period, and prevents racers from jumping the start.

Static information provided by sensor S5 allows a detection of a car stopped in a designated pit position, or whether the car has dynamically passed over, and missed, its pit. This discriminator capability between static and dynamic position represents a missed pit detection capability also non-existent in the current art. The IICS uses the information provided by the track sensors, incorporated track detection capability, missed pit detection capability, lane comparison capability, and the track program to control the racing vehicles and determine the current race conditions. Control actions such as power reductions, power advancement, power removal, switch activation, audible signals, and visual indicators are all actions which micro processor U7 takes with information provided by the track sensors in each operating lane, in response to a specific race program.

Visual indicators are incorporated into the preferred embodiment of the invention. They are the LCD screen U13 and a series of LEDs (D7-white, D8-yellow, and D9-green). Screen U13 is driven by LCD controller U12 and updated once every second by micro-processor U7. Analog information provided by the track sensors is accumulated and evaluated by micro-processor U7 and posted on the LCD. The measured indications may include scale miles per hour, lap count, lap time, etc. The LCD screen is also activated at initial game start up and used to present the players with choices for racing activity, number of laps, and lane choice and are selectable via the game keyboard S2. Screen U13 is also used at the race conclusion to post the winners raced at a and provide a comparison to past race winners with the information stored in EEPROM chip U8.

The LEDs are activated by micro controller U14 when commanded by micro-processor U7, and are updated once every 100 mS, displaying signal flag colors to the race participants. If micro processor U7 determines, through the information provided by the track sensors, the track detection system, or the current track program, that there is a caution condition present, the yellow LED is activated. If the track conditions are clear for racing, qualification, or practice, the green LED is displayed. If there is 1 lap left in a race, a caution period, or a qualification period, the white LED is displayed. This visual indicating system controlled by U7 is unique in the art and provides a realistic indication of actual track conditions as sensed by the IICS.

Audio enunciations and sounds are reproduced through speakers K1 and K2. These speakers are driven by a non-volatile sound chip U15 through the audio amplifier U16. Sound indicators, like the visual indicators, are prompted by game condition information provided to micro-processor U7 by the track sensors, the track detection system, or the current race conditions. Chip U15 is controlled with the sound controller micro controller U14 which receives its instructions from micro-processor U7. Sounds are played as frequently as every 100 mS, or when instructed by the control program. A non-volatile sound chip incorporates up to 90 seconds of addressable sound, via a maximum of 600 allowable addresses. Other sound generating devices could be used.

The invention provides an interactive slot car track in the form of a game which provides substantial realism. The track provides a single pit area for the slot cars which is located on the same side of the trackway, and an interactive intermediate control device to provide multiple features and capabilities not known in the art. Control may be altered to simulate different forms of vehicle racing or racing activities by means of software changes. Special features for practicing, qualifying, and racing are attained by software processes using the hardware configuration disclosed herein. With this invention, a true game format is established for slot car racing that is capable of mirroring actual racing events, involving strategy, skill, and chance.

What is claimed is:

1. An electric model car racing system comprising a power supply and at least one lane having an elongated and continuous slot and an electrical conductor which is positioned adjacent to said elongated and continuous slot of said lane, the improvement which comprises:

a. at least one sensor;

b. a hand controller; and c. a microprocessor which is connected to said hand controller and said at least one sensor and to said power supply to receive electrical current from said power supply, and is connected to said electrical conductor and provides a modified electrical current to said electrical conductor, wherein said at least one sensor communicates with said electrical conductor and said microprocessor to reduce said modified electrical current which is provided by said microprocessor to said electrical conductor in response to a signal from said sensor and in response to a signal from said hand controller wherein said hand controller which is connected to said microprocessor means is not connected to said electrical conductor except by means of said microprocessor.

2. An electric model car racing system as described in claim 1 in which the microprocessor reduces available power to said electrical conductor in response to said sensor sensing a loss of power consumption through a second electrical conductor.

3. An electric model car racing system comprising:

a. an electrical conductor for providing required electrical continuity to at least one electrically powered model car;

b. power supply means which is connected to said electrical conductor;

c. a controller;

d. an intermediate control device which is connected to said controller and said electrical conductor and which regulates a voltage supply available to said electrical conductor, wherein said intermediate control device is positioned in an electrical circuit between said controller and said electrical conductor, and wherein said controller is connected to said intermediate control device and said controller is not connected to said electrical conductor except by means of the connection to said intermediate control device.

4. An electric model car racing system as described in claim 3, further comprising an output display which is connected to said intermediate control device.

5. An electric model car racing system as described in claim 4, further comprising a sensor which communicates with said electrical conductor and said intermediate control device, whereby said intermediate control device modifies its output to a second electrical conductor in response to said sensor sensing a loss of power consumption through said electrical conductor.

6. An electric model car racing system as described in claim 4, further comprising at least one sensor which detects the proximity of at least one electrically powered model car relative to said electrical conductor and communicates with said intermediate control device, whereby said intermediate control device modifies its output to said electrical conductor in response to the position of said at least one electrically powered model car.

7. An electric model car racing system as described in claim 3, further comprising an audio system which is connected to and which receives commands from said intermediate control device.

8. An electric model car racing system as described in claim 7, further comprising a sensor which communicates with said electrical conductor and said intermediate control device, whereby said intermediate control device modifies its output to said electrical conductor in response to said sensor sensing a loss of power consumption through said electrical conductor.

9. An electric model car racing system as described in claim 7, further comprising at least one sensor which detects the proximity of at least one electrically powered model car relative to said electrical conductor and communicates with said intermediate control device, whereby said intermediate control device modifies its output to said electrical conductor in response to the position of said at least one electrically powered model car.

10. An electric model car racing system as described in claim 3, further comprising a sensor which communicates with said electrical conductor and said intermediate control device, whereby said intermediate control device modifies its output to a second electrical conductor in response to said sensor sensing a loss of power consumption through said electrical conductor.

11. An electric model car racing system as described in claim 3, further comprising at least one sensor which detects the proximity of at least one electrically powered model car relative to said electrical conductor and communicates with said intermediate control device, whereby said intermediate control device modifies its output to said electrical conductor in response to the position of said at least one electrically powered model car.

12. An electric model car racing system comprising:

a. an electrical conductor for providing required electrical continuity to at least one electrically powered model car;

b. a power supply;

c. at least one sensor; and d. a microprocessor which is connected to said at least one sensor and is connected to said power supply to receive electrical current from said power supply, and is connected to said electrical conductor and provides a modified electrical current to said electrical conductor, wherein said at least one sensor communicates with said electrical conductor and said microprocessor to reduce said modified electrical current which is provided by said microprocessor to said electrical conductor in response to a signal from said sensor.

13. An electric model car racing system as described in claim 12, further comprising a controller which is connected to said microprocessor and does not control an electrical current to said electrical conductor except by means of said microprocessor.

14. An electric model car racing system as described in claim 13, further comprising a second electrical conductor for providing required electrical continuity to at least one additional electrically powered model car, wherein said at least one sensor communicates with said second electrical conductor and controls said microprocessor to reduce said modified electrical current which is provided by said microprocessor to said electrical conductor in response to a signal from said at least one sensor, and further comprising a second controller which is connected to said microprocessor means and provides input to said microprocessor for said second electrical conductor, but which is not connected to said second electrical conductor except by means of said microprocessor.

15. An electric model car racing system as described in claim 12, further comprising a second electrical conductor for providing required electrical continuity to at least one additional electrically powered model car, wherein said at least one sensor communicates with said second electrical conductor and controls said microprocessor to reduce said modified electrical current which is provided by said microprocessor to said electrical conductor in response to a signal from said at least one sensor.

* * * * *